US005771944A

United States Patent [19]

Lin

[11] Patent Number: 5,771,944

[45] Date of Patent: Jun. 30, 1998

[54] CIRCULAR WEAVING LOOM WITH TRANSVERSE HEDDLE SHIFTING APPARATUS

[75] Inventor: Chia-Shun Lin, Chang-Hua Hsien, Taiwan

[73] Assignee: Saint Hut Co., Ltd., Taiwan

[21] Appl. No.: 808,358

[22] Filed: Feb. 28, 1997

[51] Int. Cl.[6] ..... D03D 37/00

[52] U.S. Cl. ..... 139/457; 139/50

[58] Field of Search ..... 139/457, 50

[56] References Cited

U.S. PATENT DOCUMENTS 4,355,666 10/1982 Toril ..... 139/457
4,846,229 7/1989 Starlinger-huemmer ..... 139/457
5,409,044 4/1995 Lin ..... 139/457

FOREIGN PATENT DOCUMENTS 2 051 894 1/1981 United Kingdom ..... 139/457

*Primary Examiner*—Andy Falik
*Attorney, Agent, or Firm*—Banner & Witcoff, Ltd.

[57] ABSTRACT

A loom includes a machine bed and a heddle unit which is disposed movably on the machine bed and which consists of a first heddle and a second heddle respectively adapted to carry an adjacent pair of warps thereon so as to form a shed between the warps. The first heddle moves vertically and reciprocally between a top position and a bottom position. The second heddle moves initially along an N-shaped path and subsequently returns from the end point of the path to the starting point of the path along a straight line which intersects the path. Accordingly, the warps are twisted.

2 Claims, 13 Drawing Sheets

CIRCULAR WEAVING LOOM WITH TRANSVERSE HEDDLE SHIFTING APPARATUS

BACKGROUND OF THE INVENTION

1. Field of the Invention

The invention relates to a weaving loom, more particularly to a weaving loom which includes a heddle driving assembly adapted to drive the heddles with warps in such a manner that the warps are twisted relative to the wefts so as to form a strong textile structure associated with a leno design.

2. Description of the Related Art

The improvement of this invention is directed to a heddle driving assembly employed in a conventional circular weaving loom shown in FIGS. 1 and 2. As illustrated in FIGS. 2 and 3, the conventional loom 10 includes a heddle unit which is disposed movably on a machine bed and which consists of a first heddle 15 and a second heddle 16 respectively adapted to carry an adjacent pair of warps 100 thereon so as to form a shed between the warps 100, and an endless raceway along which a shuttle (not visible) runs so as to extend a weft 200 through the shed. Note that each of the first and second heddles 15, 16 moves vertically and reciprocally between a top position and a bottom position along a uniform path so that the textile structure thus woven has a predetermined thickness. When it is desired to manufacture a cloth of stronger strength, the heddle driving assembly of the conventional loom is unable to fulfill the requirement because the traveling path of the heddle unit cannot be altered so as to form a cloth of increased thickness.

SUMMARY OF THE INVENTION

The object of this invention is to provide a weaving loom which includes a heddle driving assembly adapted to drive the heddle unit in a unique path such that the warps can be twisted relative to the wefts so as to form a strong textile structure.

A weaving loom of this invention includes a machine bed, a heddle unit which is disposed movably on the machine bed and which consists of a first heddle and a second heddle respectively adapted to carry an adjacent pair of warps thereon so as to form a shed between the warps, means for moving the first heddle vertically and reciprocally between a top position and a bottom position, and a driving assembly for moving the second heddle along an N-shaped path. The N-shaped path includes a starting point from which the second heddle starts initially and an end point. The driving assembly drives the second heddle to return from the end point to the starting point along a straight line. The N-shaped path has a left vertical section and a right vertical section such that the second heddle is located at either of the upper ends of the left and right vertical sections when the first heddle is located at the bottom position. The second heddle is located at either of the lower ends of the vertical sections when the first heddle is located at the top position so as to define the shed between the warps. Location of the second heddle on the left vertical section of the N-shaped path positions one of the warps, which is carried on the second heddle, on one side of the first heddle, and then locating the second heddle on the right vertical section of the N-shaped path positions the warp carried by the second heddle on the opposite side of the first heddle so as to twist the warps.

Since the warps are twisted around the wefts during the weaving operation, the textile structure thus woven is consequently thicker when compared to that woven by the conventional loom. The textile structure is therefore both durable and lasting.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
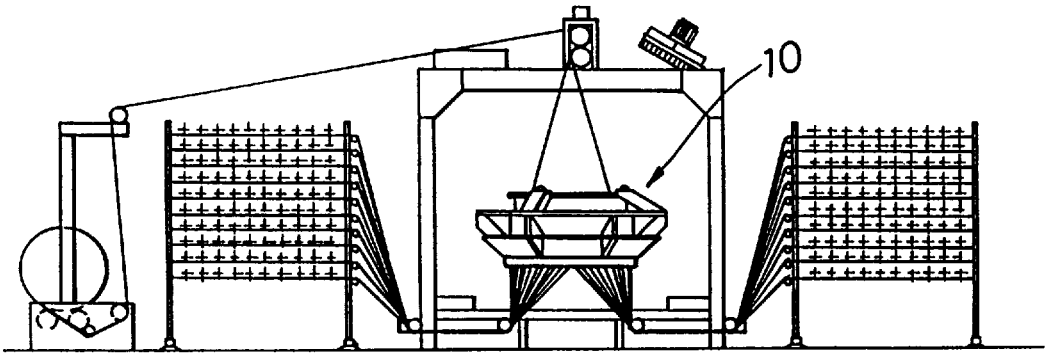
FIG. 1 PRIOR ART
FIG. 1 is a schematic view of a conventional circular loom.
Figure 2:
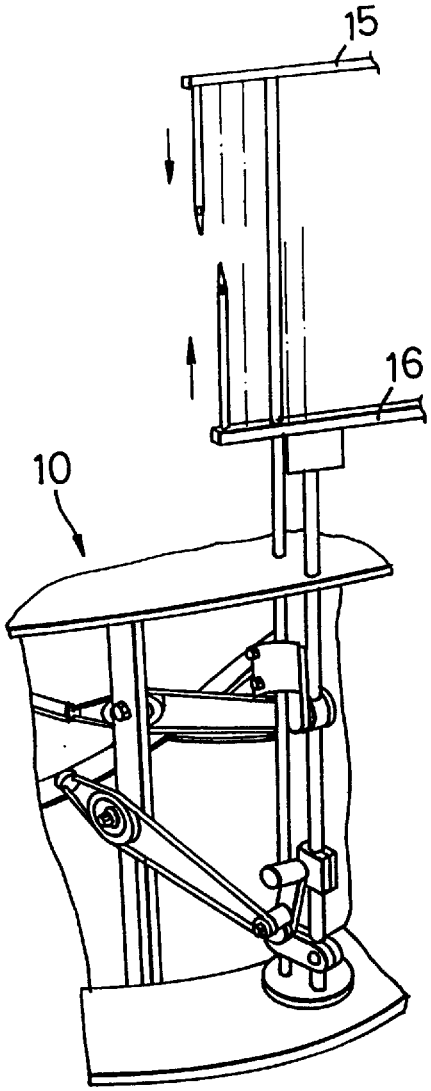
FIG. 2 PRIOR ART
FIGS. 2 and 3 illustrate how the heddle unit of the conventional loom moves reciprocally and vertically during the weaving operation thereof.
Figure 3:
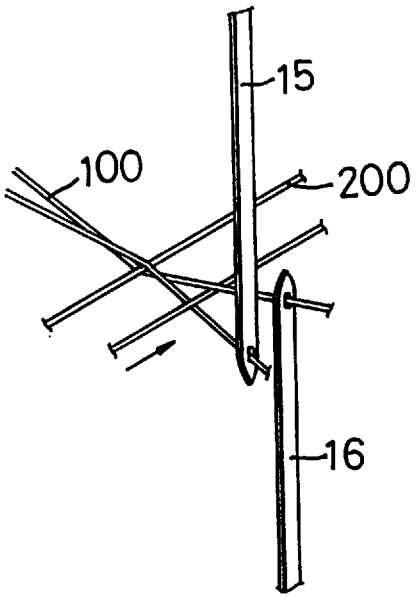
FIG. 3 PRIOR ART
Figure 4:
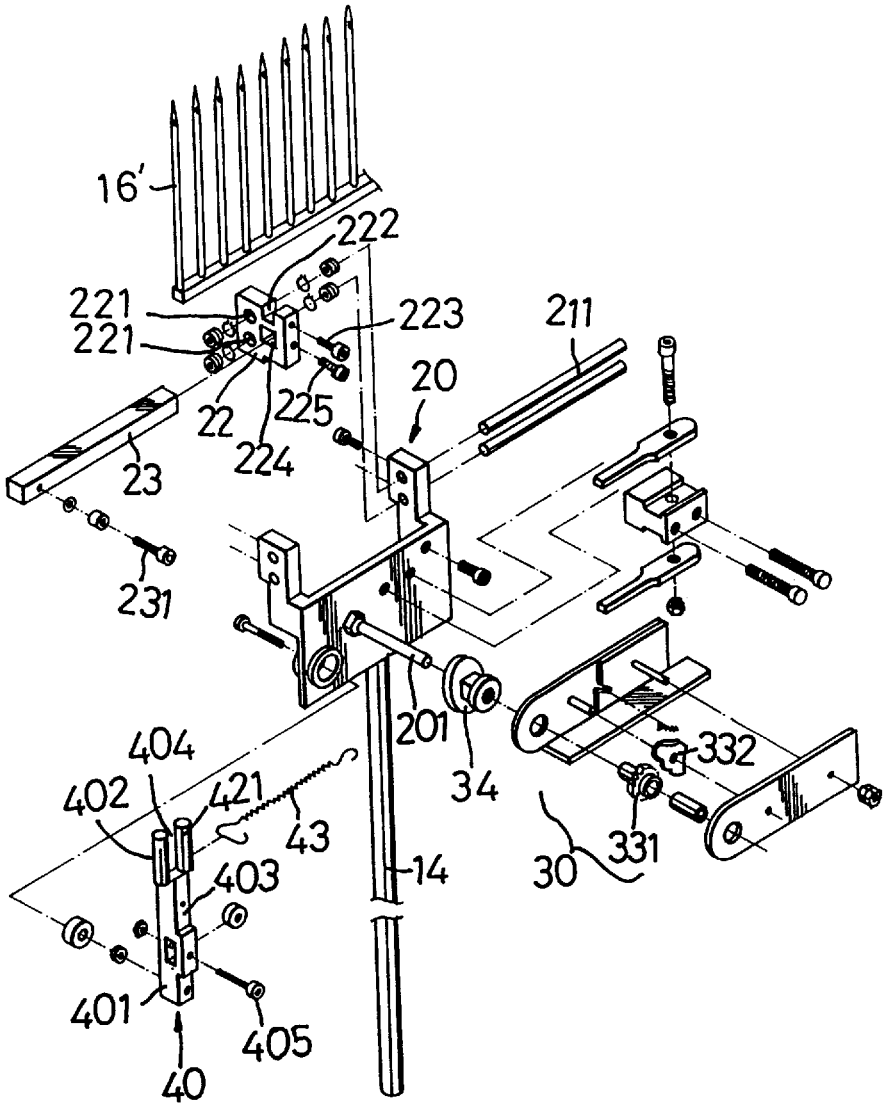
FIG. 4 is an exploded view of a driving assembly employed in the circular loom of this invention.
Figure 5:
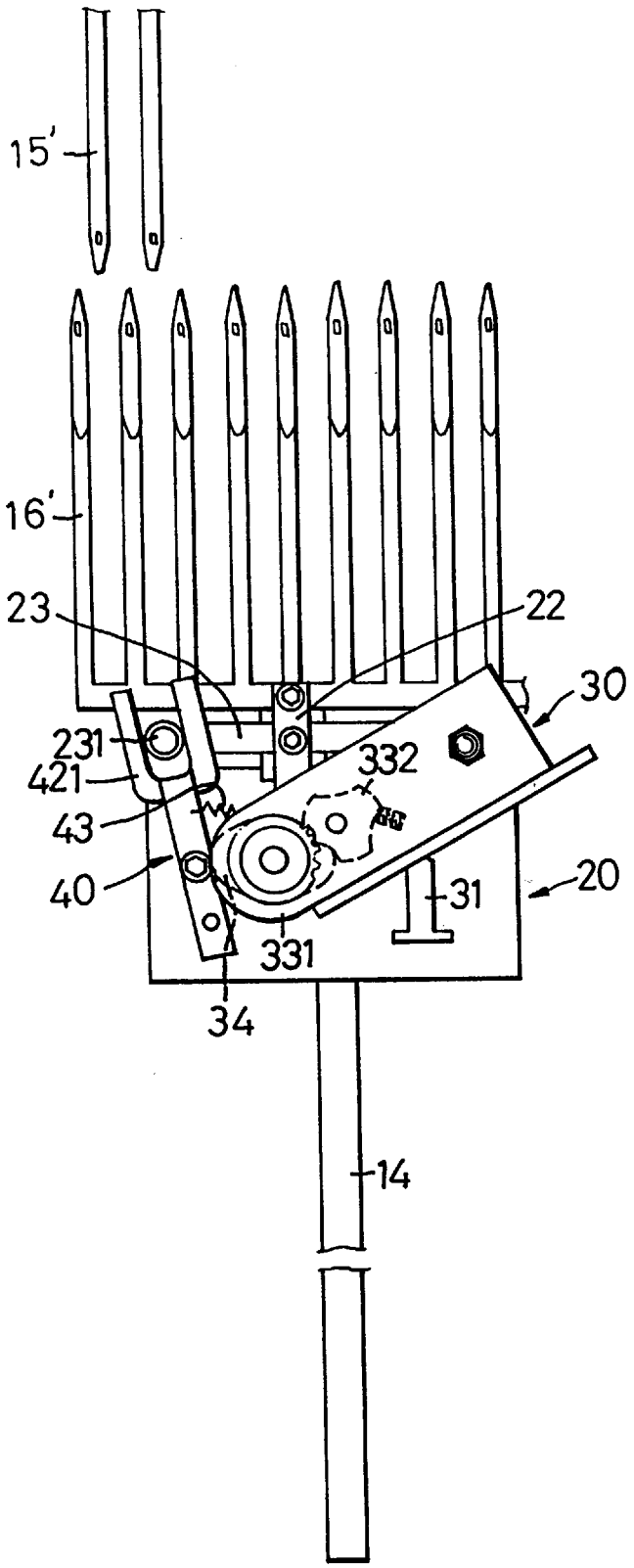
FIGS. 5, 6, 7 and 8 illustrate relative positions of the first and second heddles during the weaving operation thereof.

Referring to FIGS. 4 and 5, the preferred embodiment of a circular weaving loom of this invention includes a machine bed (not shown), a heddle unit disposed movably on the machine bed and consisting of a leftmost first heddle 15' and a leftmost second heddle 16' which are respectively adapted to carry an adjacent pair of warps thereon so as to form a shed between the warps, means for moving the first heddle 15' vertically and reciprocally between a top position and a bottom position which is located under the top position, and a driving assembly for moving the second heddle 16'.

Note that the means for moving the first heddle 15', and the shuttle (not shown), which carries the weft for extending through the shed, of the preferred embodiment are similar to those disclosed in U. S. Pat. No. 5,409,044. Since the present invention does not relate to the specific structure and operation of these two elements, a detailed disclosure of the same will be left out of the specification.

As illustrated, the driving assembly includes a rectangular base 20, an elliptical cam 34, a ratchet wheel 331, an elongated pawl carrier 30, a springbiased pawl member 332, a slide rod 23, a stationary stop rod 31 (see FIG. 5), and a swing arm 40. The base 20 is fixed on the top of a vertically and reciprocally movable carrier post 14 which is driven on the machine bed in a known manner. A mounting seat 22 has two parallel holes 221 (see FIG. 4) so as to be sleeved slidably on the guide rails 211 of the base 20. The cam 34 is mounted rotatably on the horizontal pivot pin 201 of the base 20. The ratchet wheel 331 is connected coaxially to the cam 34 so as to be corotatable therewith. The pawl carrier 30 has an end portion mounted rotatably on the pivot pin 201 of the base 20. The pawl member 332 is mounted pivotally on the pawl carrier 30 and is spring-biased in such a manner that the pawl member 332 constantly engages the ratchet wheel 331, thereby permitting the ratchet wheel 331 to rotate only in a predetermined direction. The second heddle 16' is disposed fixedly in the accommodation recess 222 of the mounting seat 22 and is locked on the seat 22 by a locking bolt 223.

The stationary stop rod 31 is positioned on the machine bed (not visible) so as to block and prevent the pawl carrier 30 from turning downwardly when the base 20 moves downwardly, thus permitting the cam 34 to rotate in the predetermined direction only when the base 20 moves downward.

The slide rod 23 extends through the sliding hole 224 of the mounting seat 22 and has a transverse pin 231 fixed on an end portion thereof, and an intermediate portion fixed to the seat 22 by a locking bolt 225 such that the second heddle 16' slides Or synchronously with the slide rod 23.

The elongated swing arm 40 has a lower end portion 401 pivoted to the base 20 by means of a screw 405, an upper end portion 402 formed with two spaced stubs 421 defining a longitudinal slide slot 404 therebetween, and an intermediate portion 403 which is pulled by a tension spring 43 so as to abut against the cam 34. The transverse pin 231 of the slide rod 23 extends through the slide slot 404 of the swing arm 40. When the post 14 moves reciprocally and vertically during the weaving operation, the cam 34 rotates in the predetermined direction to swing the arm 40 only when the base 20 moves downwardly. When the base 20 moves downwardly on the machine bed, the second heddle 16' effects a horizontal reciprocal movement on the base 20. When the base 20 moves upward relative to the machine bed, the second heddle 16' is fixed on the base 20.

Figure 4A:
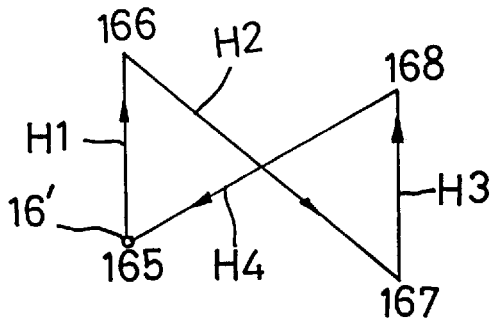
FIG. 4A is a schematic view illustrating the path of the second heddle of the circular loom according to this invention.

The reciprocal and vertical moving path of the first heddle 15' remains the same as in the conventional loom. However, the second heddle 16 moves, in addition to the conventional upward and downward vertical movement, along an N-shaped path due to reciprocal movement of the slide rod 23 on the base 20 when moving downwardly. As illustrated in FIG. 4A, the N-shaped path includes a starting point 165 from which the second heddle 16' starts, and an end point 168. Upon reaching the end point 168, the driving assembly drives the second heddle 16' to return from the end point 168 to the starting point 165 along a straight line H4.

Figure 6:
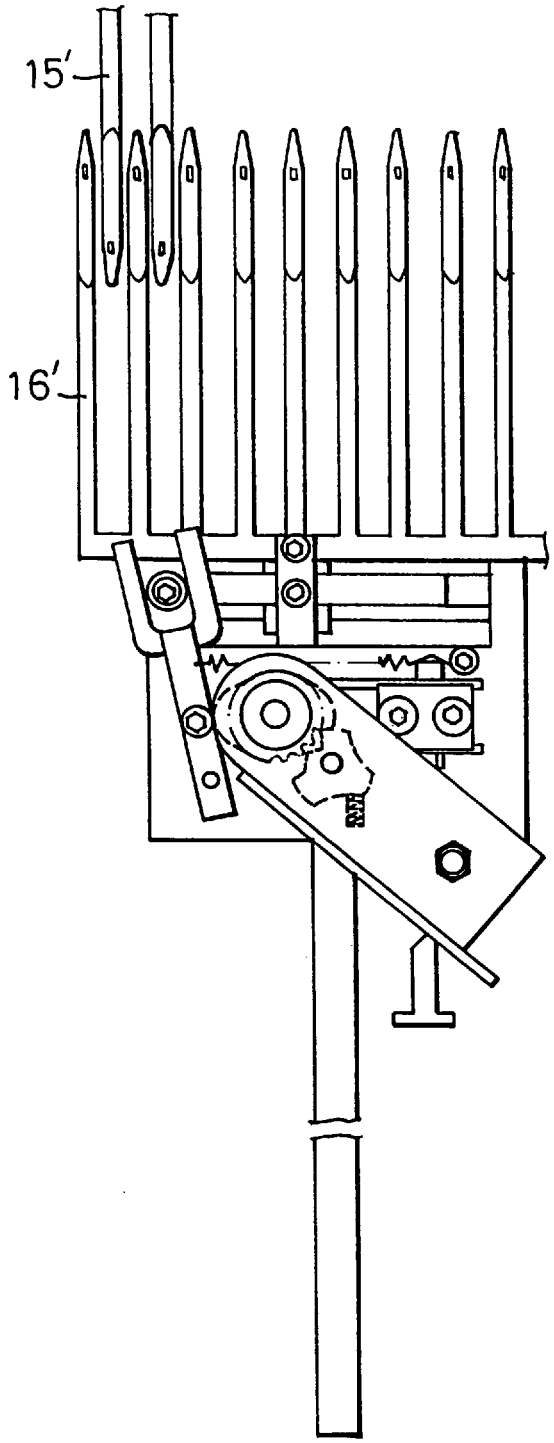
Figure 7:
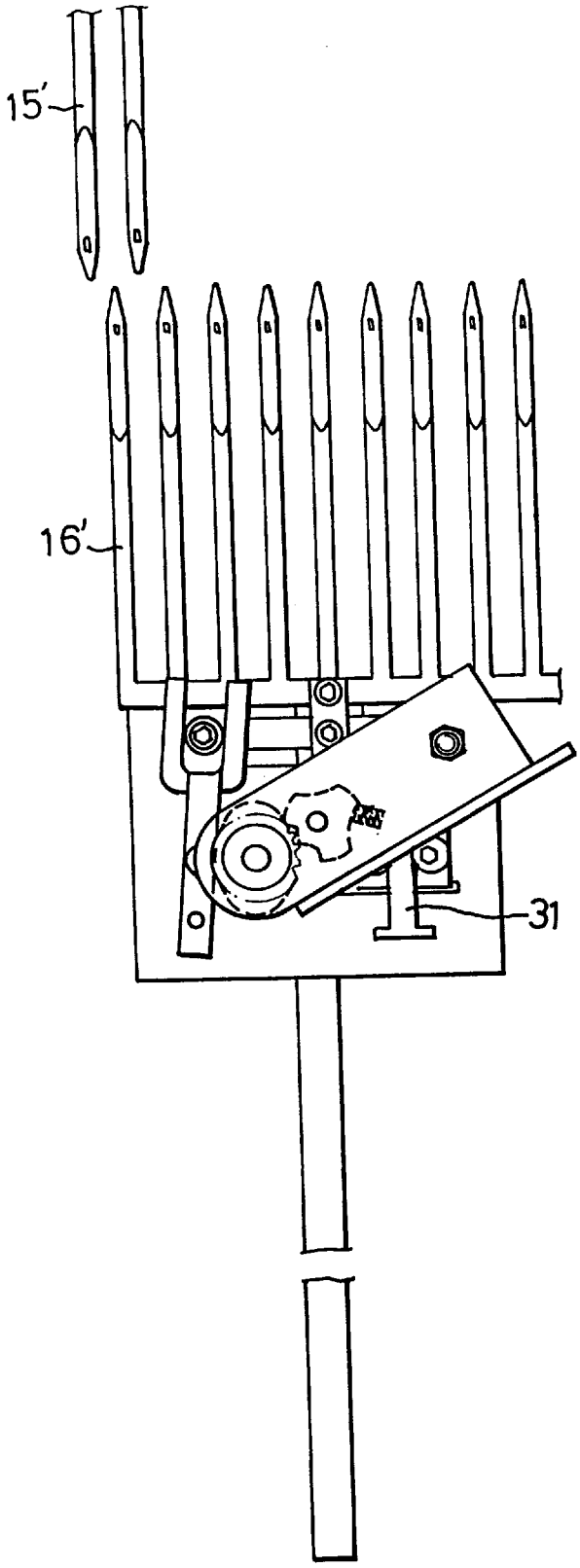
Figure 8:
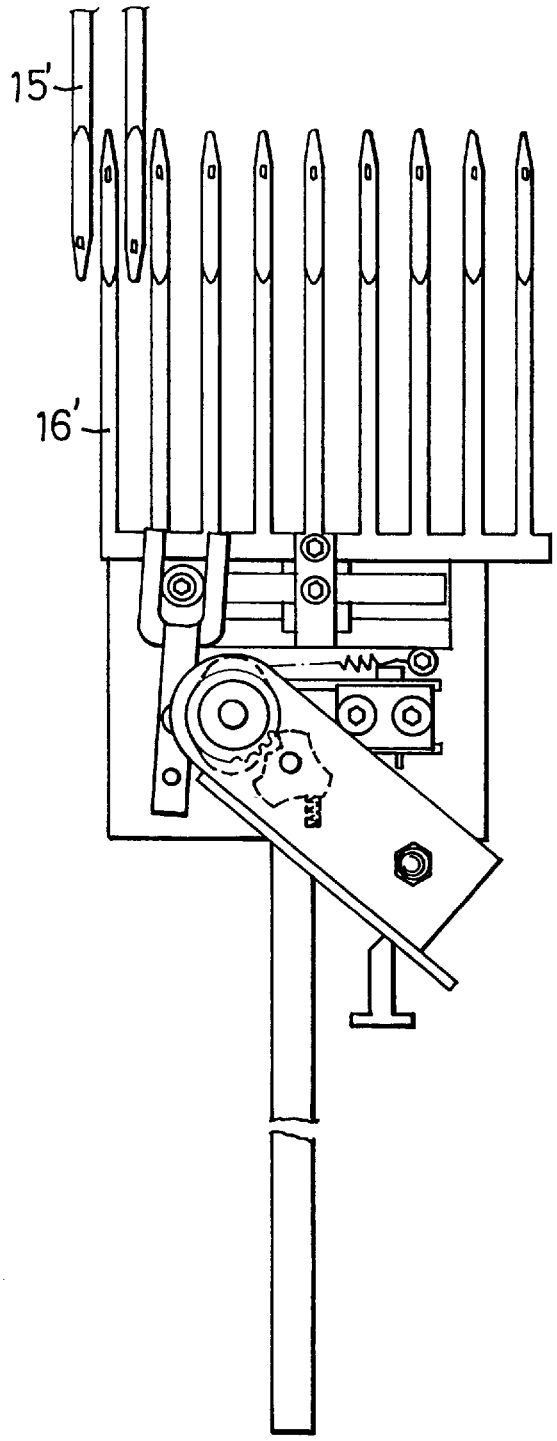

In other words, the N-shaped path has a left vertical section H1, a rightward and downward inclined section H2 which intersects the line H4, and a right vertical section H3. As illustrated in FIGS. 4A, 6 and 8, the second heddle 16' is located at either of the upper ends of the left and right vertical sections H1, H3 when the first heddle is located at the bottom position. As illustrated in FIGS. 4A, 5 and 7, the second heddle 16' is located at either of the lower ends of the vertical sections H1, H3 when the first heddle 15' is located at the top position so as to define the shed between the warps for extension of the shuttle therethrough. Referring to FIG. 4A, when the second heddle 16' moves from the starting point 165 to the end point 168 via the positions 166 and 167, the first heddle 15 (see FIG. 5) moves relative to the second heddle 16' from the position of FIG. 5 to the position of FIG. 8 via the positions of FIGS. 6 and 7.

Figure 9:
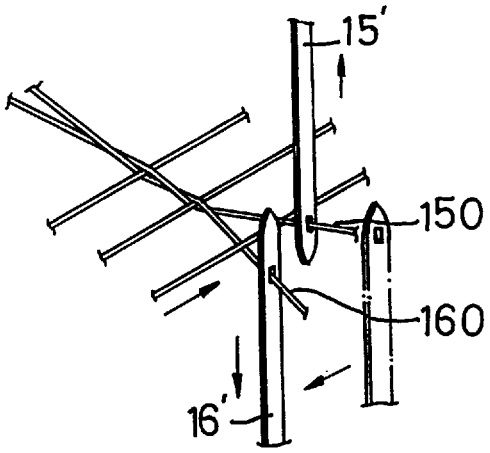
FIGS. 9 and 10 illustrate how the second heddle moves horizontally relative to the first heddle during the weaving operations.
Figure 10:
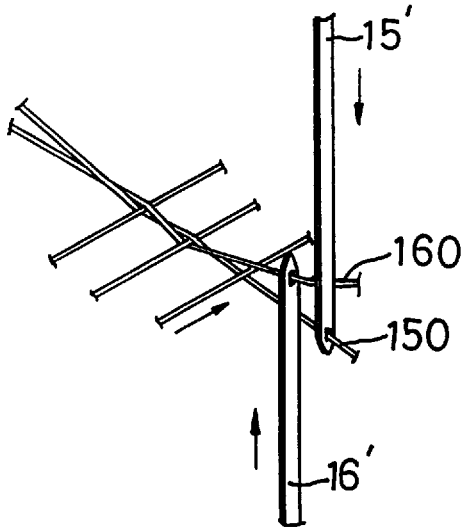
Figure 11A:
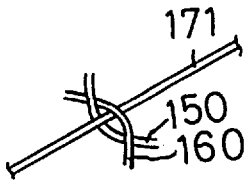
FIGS. 11A, 11B, 11C and 11D illustrate how the warps are twisted relative to the wefts according to this invention.
Figure 11B:
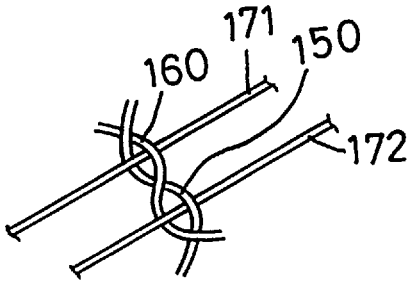
Figure 11C:
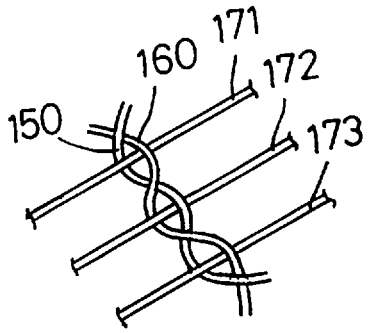
Figure 11D:
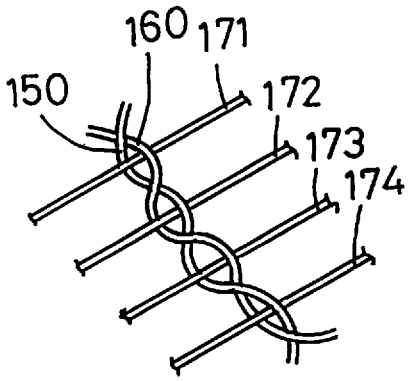

As best illustrated in FIGS. 9 and 10, during the weaving operation, location of the second heddle 16' on the left vertical section can position one of the warps, which is carried on the second heddle 16', at one side of the first heddle 15', whereas location of the second heddle 16' on the right vertical section can position the warp at the opposite side of the first heddle 15'. FIGS. 11A,,11B, 11C, 11D illustrate the relationship among the warp 150 carried on the first heddle 15' (see FIGS. 9 and 10), the warp 160 carried on the second heddle 16' (see FIGS. 9 and 10) and the wefts. The wefts are inserted between the warps in a manner well known in the art. One patent disclosing this method is U.S. Pat. No. 5,409,044 to Lin and specific references can be found at column 1, lines 15–49 and column 4, lines 34–44 of that patent. As discussed above, the means for moving the first heddle 15' and the shuttle (not shown) are similar to those disclosed in U.S. Pat. No. 5,409,044. FIG. 11A shows a first weft 171 which extends between the warps 150 and 160 upon location of the heddles on the position of FIG. 5. FIG. 11B shows a second weft 172 which extends between the warps 150 and 160 upon location of the heddles on the position of FIG. 6. FIG. 11C shows a third weft 173 which extends between the warps 150 and 160 upon location of the heddles on the position of FIG. 7. FIG. 11D shows a fourth weft 174 which extends between the warps 150 and 160 upon location of the heddles on the position of FIG. 8. As a result, the warps are twisted relative to the wefts such that the textile structure possesses a thickness that is greater than that produced by the conventional weaving loom.

With this invention thus explained, it is apparent that numerous modifications and variations can be made without departing from the scope and spirit of this invention. It is therefore intended that this invention be limited only as indicated in the appended claims.

I claim:

1. A circular weaving loom comprising:

a machine bed;

a heddle unit disposed movably on said machine bed and including a first heddle and a second heddle which are respectively adapted to carry an adjacent pair of warps thereon so as to form a shed between the warps;

means for moving said first heddle vertically and reciprocally between a top position and a bottom position which is located under the top position; and a driving assembly for initially moving said second heddle along an N-shaped path which has a starting point from which said second heddle starts and an end point, and subsequently returning said second heddle from said end point to said starting point along a straight line which intersects said N-shaped path, said N-shaped path having a left vertical section and a right vertical section, said second heddle being located at either of upper ends of said left and right vertical sections when said first heddle is located at said bottom position, said second heddle being located at either of lower ends of said vertical sections when said first heddle is located at said top position so as to define said shed between the warps, wherein the warp carried by said second heddle is positioned on a first side of said first heddle when said second heddle is located along said left vertical section and positioned on a second side of said first heddle opposite said first side when said second heddle is located along said right vertical section so as to twist the adjacent pair of warps.

2. A circular weaving loom as claimed in claim 1, wherein said driving assembly includes:

a base mounted movably on said machine bed and being capable of effecting a vertical reciprocal movement on said machine bed;

a horizontal pivot pin fixed on said base;

an elliptical cam mounted rotatably on said base by means of said pivot pin;

a ratchet wheel connected coaxially and fixedly to said cam;

an elongated pawl carrier having an end portion mounted rotatably on said base by means of said pivot pin;

a spring-biased pawl member mounted pivotally on said pawl carrier so as to engage said ratchet wheel, thereby permitting said ratchet wheel to rotate only in a predetermined direction;

a stationary stop rod positioned relative to said base so as to block and prevent said pawl carrier from turning downwardly when said base moves downwardly, thus rotating said cam only when said base moves downwardly;

a slide rod mounted horizontally and slidably on said base and having a fixed transverse pin, said second heddle being fixed on said slide rod; and a swing arm having a lower end portion pivoted to said base, an upper end portion with a longitudinal slide slot formed therethrough, and an intermediate portion biased to contact said cam, said transverse pin of said slide rod extending through said slide slot of said swing arm, said cam rotating in said predetermined direction to swing said arm only when said base moves downwardly, whereby, when said base moves upwardly on said machine bed, said second heddle is fixed on said base, and when said base moves downwardly on said machine bed, said second heddle effects a horizontal reciprocal movement on said base.

* * * * *